US006276433B1

(12) United States Patent
Gigliotti, Jr. et al.

(10) Patent No.: US 6,276,433 B1
(45) Date of Patent: Aug. 21, 2001

(54) LIQUID METAL COOLED DIRECTIONAL SOLIDIFICATION PROCESS

(75) Inventors: Michael Francis Xavier Gigliotti, Jr., Scotia; Shyh-Chin Huang, Latham; Roger John Petterson, Fultonville; Ji-Cheng Zhao, Niskayuna, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/425,307

(22) Filed: Oct. 25, 1999

(51) Int. Cl.[7] ..... B22D 27/04; B22D 27/00; B22D 17/10

(52) U.S. Cl. ..... 164/122.1; 164/126; 164/128

(58) Field of Search ..... 164/126, 128

(56) References Cited

U.S. PATENT DOCUMENTS 3,763,926 * 10/1973 Tschinkel et al. ..... 164/338
4,108,236 * 8/1978 Salkeld ..... 164/338
5,988,257 * 11/1999 Hugo ..... 164/122.1
6,003,587 * 12/1999 Mitsuhashi ..... 164/122.1

* cited by examiner

*Primary Examiner*—Tom Dunn
*Assistant Examiner*—Kevin McHenri
(74) *Attorney, Agent, or Firm*—Noreen C. Johnson; Douglas E. Stoner

(57) ABSTRACT

A liquid metal cooled directional solidification process provides improved solidification characteristics at the solidification front. In the process, a mold is filled with molten metal; and a solidification interface is caused to pass through the molten metal by progressively immersing the mold into a cooling liquid. The cooling liquid is a eutectic or near eutectic metal composition. A directional solidification furnace includes a heating furnace, a liquid cooling bath and a mold positioner. The heating furnace has an open bottom end through which a heated mold containing molten metal is lowered from the furnace. The liquid cooling bath comprises a molten eutectic or near eutectic metal composition positioned beneath the open end of the furnace. The mold positioner gradually lowers the heated mold from the furnace, through the open end and immerses the mold into the liquid cooling bath.

23 Claims, 1 Drawing Sheet

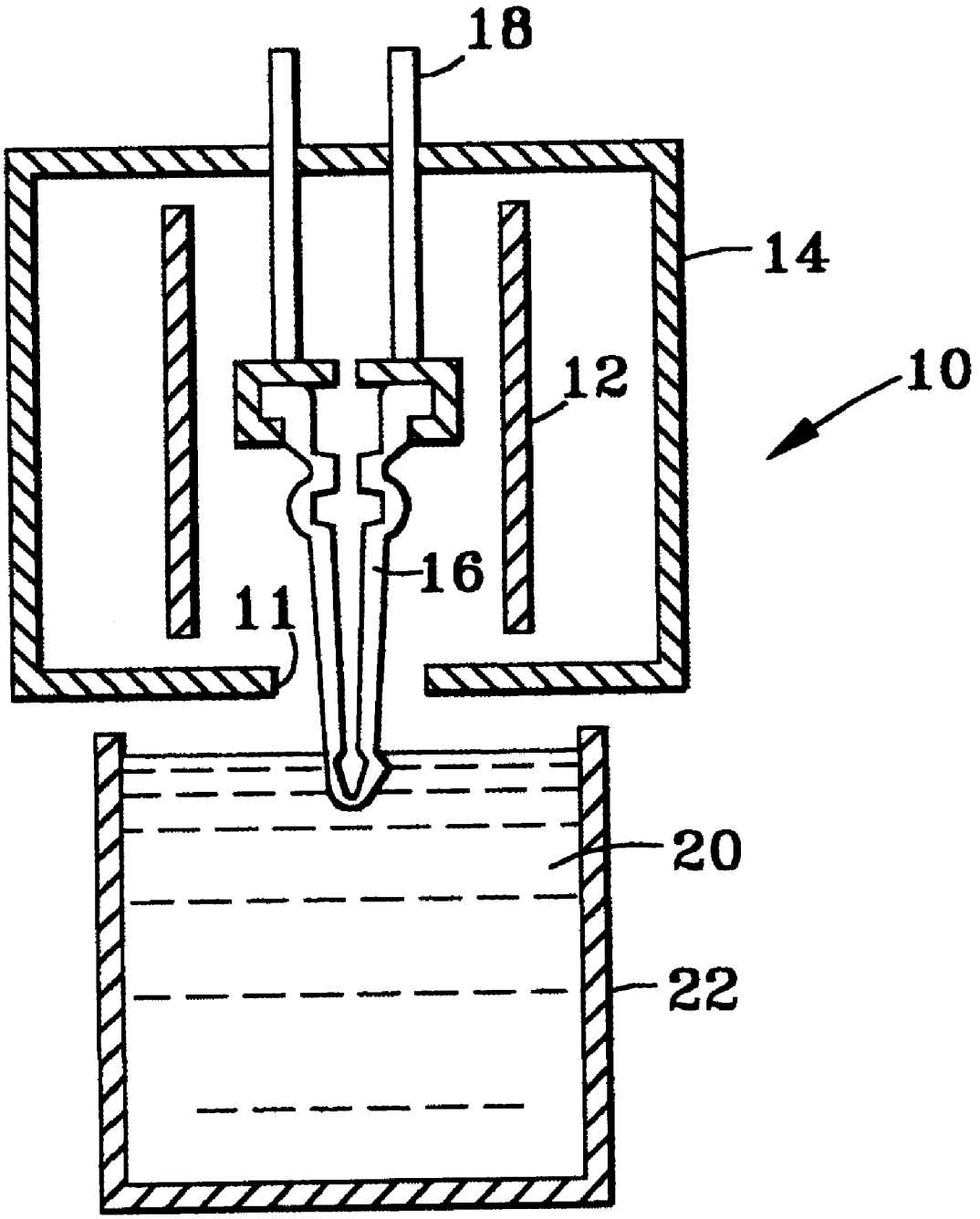
18
14
10
12
16
11
20
22

LIQUID METAL COOLED DIRECTIONAL SOLIDIFICATION PROCESS

BACKGROUND OF THE INVENTION

The present invention relates to a liquid metal cooled directional solidification casting process. More particularly, the invention relates to a liquid metal cooled direction solidification process for casting superalloys.

In addition to composition, the crystal grain characteristics of a superalloy can determine superalloy properties. For example, the strength of a superalloy is determined in part by grain size. At high temperatures, deformation processes are diffusion controlled and diffusion along grain boundaries is much higher than within grains. Hence at high temperatures, large-grain size structures can be stronger than fine grain structures. Generally, failure originates at grain boundaries oriented perpendicular to the direction of an applied stress. By casting a superalloy to produce an elongated columnar structure with unidirectional crystals aligned substantially parallel to the long axis of the casting, grain boundaries normal to the primary stress axis can be reduced. Further, by making a single crystal casting of a superalloy, grain boundary failure modes can be almost entirely eliminated.

Directional solidification is a method for producing turbine blades and the like with columnar and single crystal growth structures. Generally, a desired single crystal growth structure is created at the base of a vertically disposed mold defining a part. Then, a single crystal solidification front is propagated through the structure under the influence of a moving thermal gradient.

During directional solidification, crystals of nickel, cobalt or iron-based superalloys are characterized by a "dendritic" morphology. Dendritic refers to a form of crystal growth where forming solid extends into still molten liquid as an array of fine branched needles. Spacing between the needles in the solidification direction is called "primary dendrite arm spacing." A temperature gradient must be impressed in front of an advancing solidification front to avoid nucleation and growth of parasitic dendritic grains. The magnitude of the required gradient is proportional to the speed of solidification. For this reason, the speed of displacement of the solidification front, which can be on the order of a fraction of a centimeter to several centimeters per hour, must be carefully controlled. Liquid metal cooled directional solidification processes have been developed to meet these requirements. In one process, the alloy material being heated is passed first through a heating zone and then into a cooling zone. The heating zone can consist of an induction coil or resistance heater while the cooling zone is constituted by a liquid metal bath. In another process, the liquid metal bath is utilized both for heating and cooling to provide an improved planar solidification front for the casting of complex articles.

Metals typically used for the liquid metal bath include metals with melting points less than 700° C. Metals with melting points less than 700° C. include lithium (186° C.), sodium (98° C.), magnesium (650° C.), aluminum (660° C.), potassium (63° C.), zinc (419° C.), gallium (30° C.), selenium (220° C.), rubidium (39° C.), cadium (320° C.), indium (156° C.), tin (232° C.), antimony (630° C.), tellurium (450° C.), cesium (28° C.), mercury (−39° C.), thallium (300° C.), lead (327° C.) and bismuth (276° C.). Lithium, sodium, potassium and cesium are very flammable and would present safety issues if used as a liquid metal bath. Magnesium, calcium, zinc, rubidium, cadmium, antimony, bismuth and mercury have low vapor pressures. They would evaporate and contaminate the casting alloy and furnace. Selenium, cadmium, tellurium, mercury, thallium and lead are toxic. Gallium and indium are expensive. Aluminum and tin are preferred coolants. Tin is heavier and more expensive than aluminum, and Tin will contaminate a superalloy if it penetrates through the mold. Aluminum will not contaminate since it is a constituent of most superalloys, but the melting point of aluminum is higher than that of tin. Since heat transfer between a casting and coolant is a function of temperature difference, liquid tin is better than liquid aluminum in removing heat from a casting.

There remains a need to identify a coolant for a liquid metal cooling directional solidification process that has the advantages of tin and aluminum with a melting point less than aluminum and a density and cost less than tin.

SUMMARY OF THE INVENTION

The invention relates to a liquid metal cooled directional solidification process that provides improved solidification characteristics at the solidification front. In the process, a mold is filled with molten metal and a solidification interface is caused to pass through the molten metal by progressively immersing the mold into a cooling liquid. The cooling liquid is a eutectic or near eutectic metal composition.

In another aspect, the invention is a directional solidification furnace that comprises a heating furnace, a liquid cooling bath and a mold positioner. The heating furnace has an open end through which a heated mold containing molten metal is lowered from the furnace. The liquid cooling bath comprises a molten eutectic or near eutectic metal composition positioned beneath the open end of the furnace. The mold positioner gradually lowers the heated mold from the furnace, through the open end and immerses the mold into the liquid cooling bath.

BRIEF DESCRIPTION OF THE DRAWING

FIG. 1 is a schematic sectional elevation view of a furnace for conducting a directional solidification process.

DETAILED DESCRIPTION OF THE INVENTION

As used herein, the term "superalloy" refers to a nickel, cobalt or iron-based heat resistant alloy that has superior strength and oxidation resistance at high temperatures. The superalloy can contain chromium to impart surface stability and one or more minor constituents such as molybdenum, tungsten, columbium, titanium or aluminum for strengthening purposes. The physical properties of a superalloy make it particularly useful for the manufacture of a gas turbine component.

A satisfactory metal for the cooling bath of a directional solidification furnace should have a melting point significantly below that of the casting metal alloy and a high thermal conductivity. The metal should be chemically inert and have a low vapor pressure. According to embodiments of the invention, a composition is provided for the cooling bath of a liquid metal cooling directional solidification furnace that provides higher thermal gradients at a reasonable cost. Embodiments of the invention provide alloy compositions based on binary and ternary eutectics with aluminum that offer low melting points without some of the disadvantages of tin.

A eutectic mixture is a combination of metals in a proportion that is characterized by the lowest melting point of any mixture of the same metals. The eutectic point is the lowest temperature at which a eutectic mixture can exist in liquid phase. The eutectic point is the lowest melting point of an alloy in solution of two or more metals that is obtainable by varying the proportions of the components. Eutectic alloys have definite and minimum melting points in contrast to other combinations of the same metals.

In FIG. 1, a directional solidification furnace 10 is heated by resistance heated graphite strips 12 within an insulated furnace box 14. A ceramic shell mold 16 is located within the furnace box 14 by mold positioner 18. Directional solidification is achieved by lowering a mold 16 containing a superalloy out of the heated furnace box 14 into a liquid metal cooling bath 20 through an aperture 11 in the furnace box 14. A heater puts heat into the casting; bath 20 removes heat from the casting and solidification progresses from bottom to top within mold 16. The liquid coolant bath 20 is contained in a crucible 22 of metal or refractory. The liquid coolant bath 20 is a eutectic metal composition that acts as a cooling medium according to the present invention.

Exemplary cooling bath alloys of the invention, include binary eutectics of aluminum with copper, germanium, magnesium, or silicon and ternary eutectics of aluminum with copper and germanium, copper and magnesium, copper and silicon or magnesium and silicon. Some suitable alloys are listed in the following Table.

TABLE

| Alloy Type | Melting Point ° C. | Al | Cu | Ge | Mg | Si |
|---|---|---|---|---|---|---|
| | 660 | 100 | | | | |
| binary | 548 | 67.3 | 32.7 | | | |
| binary | 420 | 48.4 | | 51.6 | | |
| binary | 450 | 64 | | | 36 | |
| binary | 437 | 33 | | | 67 | |
| binary | 577 | 87.4 | | | | 12.6 |
| ternary | <420 | 21 | 24 | 55 | | |
| ternary | 507 | 60.8 | 33.1 | | 6.1 | |
| pseudo binary | 518 | 66.1 | 23.9 | | 10 | |
| ternary | 524 | 67.7 | 27 | | | 5.3 |
| ternary | 449 | 46.5 | | 51 | 2.5 | |
| ternary | 419 | 46 | | 52 | 2 | |
| ternary | 550 | 81 | | | 4.3 | 14.7 |
| ternary | 444 | 67.8 | | | 32 | 0.2 |
| ternary | 445 | 65.8 | | | 34 | 0.2 |
| ternary | 434 | 34.7 | | | 65 | 0.3 |

In the table, the constituents are indicated in weight percent. The table shows that alloys with germanium and magnesium offer the lowest melting temperatures. However because of vapor pressure considerations, preferred alloys include an aluminum-copper-silicon ternary eutectic with a melting point of 524° C. and an aluminum-copper-germanium ternary eutectic with a melting point of less than 420° C.

The aluminum-copper-silicon ternary eutectic can comprise between about 22 and about 32 weight percent copper and between about 2 and about 8 weight percent silicon with the balance being aluminum. Desirably, the eutectic or near eutectic comprises between about 24 and about 30 weight percent copper and between about 3 and about 7 weight percent silicon with the balance being aluminum and preferably between about 25.5 and about 28.5 weight percent copper and between about 4 and about 6 weight percent silicon with the balance being aluminum.

The aluminum-copper-germanium ternary eutectic or near eutectic can comprise between about 19 and about 34 weight percent copper, between about 45 and about 65 weight percent germanium with the balance being aluminum. Desirably, the eutectic or near eutectic comprises between about 21 and about 27 weight percent copper and between about 52 and about 58 weight percent germanium with the balance aluminum and preferably between about 22.5 and about 25.5 weight percent copper and between about 53.5 and about 56.5 weight percent germanium with the balance being aluminum.

The eutectic or near eutectic alloy can be prepared as an ingot outside of the directional solidification furnace by melting and casting the alloy constituents into ingots. Or, the eutectic or near eutectic alloy can be prepared in situ by melting constituents within crucible 22.

In operation, the furnace box 14 is preheated to a sufficiently high temperature to insure that alloy in shell mold 16 is melted. Mold 16 is then lowered by means of mold positioner 18 into the liquid eutectic metal coolant 20 at a prescribed rate. A solid-liquid interface advances upward as heat is conducted from the alloy within the shell mold 16 and is carried away by the eutectic cooling metal. An ingot is fully formed after the alloy is sufficiently cooled by immersion into the cooling bath 20. The ingot can then be easily removed from the shell mold 16.

EXAMPLE 1

The following Example 1 illustrates a directional solidification process conducted utilizing an aluminum metal cooling bath. In this process, a turbine blade casting is first cast in a mold that is made from AISI 309 stainless steel (Fe—13.5 wt % Ni, 23 wt % Cr and 0.2 wt % C). The mold and casting are lowered into a bath of molten aluminum at a rate of 0.5 cm/minute. The temperature of the molten aluminum is maintained at 710° C., approximately 50° C. above the melting temperature of the pure aluminum. The thermal gradient measured in the cast part is 98° C./cm. The measured rate of dissolution of the stainless steel mold into the molten aluminum is 0.001 mm/hour.

EXAMPLE 2

A turbine blade casting is made by a liquid metal cooling process using a cooling bath of molten alloy aluminum (12 wt % Si). A turbine blade casting is cast in an AISI 309 stainless steel mold and is lowered into the molten binary eutectic alloy aluminum cooling bath at a rate of 0.5 cm/minute. The temperature of the molten alloy cooling bath is maintained at 625° C., approximately 50° C. above the 577° C. melting temperature of the alloy. The thermal gradient in the cast part is 103° C./cm, a 5% improvement over the base case of Example 1. The measured rate of dissolution of the stainless steel container into the molten aluminum alloy was 0.0002 mm/hour, a five-fold reduction in the rate of attack as compared to Example 1.

EXAMPLE 3

A turbine blade casting is made by a liquid metal cooling process using a cooling bath of molten alloy aluminum (27 wt % Cu, 5.3 wt % Si). A turbine blade casting is cast in an AISI 309 stainless steel mold and is lowered into the molten ternary eutectic alloy aluminum cooling bath at a rate of 0.5 cm/minute. The temperature of the molten alloy cooling bath is maintained at 575° C., approximately 50° C. above the 524° C. melting temperature of the alloy. The thermal gradient in the cast part is 106° C./cm, an 8% improvement over the base case of Example 1. The measured rate of dissolution of the stainless steel container into the molten aluminum alloy was 0.0001 mm/hour, a ten-fold reduction in the rate of attack as compared to Example 1.

The Examples illustrate the improved cooling characteristics obtainable with the eutectic alloy metal cooling baths of embodiments of the present invention.

While preferred embodiments of the invention have been described, the present invention is capable of variation and modification and therefore should not be limited to the precise details of the examples. The invention includes changes and alterations that fall within the purview of the following claims.

What is claimed:

1. A liquid metal cooled directional solidification process, comprising:

filling a mold with molten metal; and immersing said mold into a cooling liquid eutectic or near eutectic metal composition.

2. The process of claim 1, wherein said eutectic or near eutectic metal composition is an aluminum-copper-silicon eutectic or near eutectic or an aluminum-copper-germanium eutectic or near eutectic.

3. The process of claim 2, wherein said eutectic or near eutectic metal composition comprises between about 22 and about 32 weight percent copper and between about 2 and about 8 weight percent silicon with the balance being aluminum.

4. The process of claim 2, wherein said eutectic or near eutectic metal composition comprises aluminum with between about 24 and about 30 weight percent copper and between about 3 and about 7 weight percent silicon.

5. The process of claim 2, wherein said eutectic or near eutectic metal composition comprises aluminum with between about 25.5 and about 28.5 weight percent copper and between about 4 and about 6 weight percent silicon.

6. The process of claim 2, wherein said eutectic or near eutectic metal composition comprises aluminum with between about 19 and about 34 weight percent copper, between about 45 and about 65 weight percent germanium.

7. The process of claim 2, wherein said eutectic or near eutectic metal composition comprises aluminum with between about 21 and about 27 weight percent copper and between about 52 and about 58 weight percent germanium.

8. The process of claim 2, wherein said eutectic or near eutectic metal composition comprises aluminum with between about 22.5 and about 25.5 weight percent copper and between about 53.5 and about 56.5 weight percent germanium.

9. The process of claim 1, wherein said eutectic or near eutectic metal composition is a binary eutectic or near eutectic of aluminum with copper, germanium, magnesium or silicon.

10. The process of claim 1, wherein said eutectic or near eutectic metal composition is a ternary eutectic or near eutectic of (i) aluminum with copper and magnesium or (ii) aluminum with magnesium and silicon.

11. The process of claim 1, wherein the mold is immersed into the cooling liquid progressively, to cause a solidification interface to pass through said molten metal.

12. A liquid metal cooled directional solidification process, comprising:

maintaining a hot zone at a temperature above the liquidus temperature of a metal within a mold;

maintaining a cold zone comprising a liquid eutectic or near eutectic metal composition at a temperature below the solidus temperature of the metal; and withdrawing said mold progressively from said hot zone into said cold zone to effect movement of a solidification interface through said metal within said mold to form said casting from said metal.

13. The process of claim 12, wherein said eutectic or near eutectic metal composition is an aluminum-copper-silicon eutectic or near eutectic or an aluminum-copper-germanium eutectic or near eutectic.

14. A directional solidification furnace, comprising:

a heating furnace having an bottom open end through which a heated mold containing molten metal is withdrawn;

a liquid cooling bath comprising a molten eutectic or near eutectic metal composition positioned beneath the open end of the furnace; and a mold positioner supporting said mold for gradually lowering the mold from the furnace, through the open end and immersing said mold into said liquid cooling bath.

15. The furnace of claim 14, wherein said eutectic or near eutectic metal composition is an aluminum-copper-silicon eutectic or near eutectic or an aluminum-copper-germanium eutectic or near eutectic.

16. The furnace of claim 15, wherein said eutectic or near eutectic metal composition comprises aluminum and between about 22 and about 32 weight percent copper and between about 2 and about 8 weight percent silicon.

17. The furnace of claim 15, wherein said eutectic or near eutectic metal composition comprises aluminum and between about 24 and about 30 weight percent copper and between about 3 and about 7 weight percent silicon.

18. The furnace of claim 15, wherein said eutectic or near eutectic metal composition comprises aluminum and between about 25.5 and about 28.5 weight percent copper and between about 4 and about 6 weight percent silicon.

19. The furnace of claim 15, wherein said eutectic or near eutectic metal composition comprises aluminum and between about 19 and about 34 weight percent copper and between about 45 and about 65 weight percent germanium.

20. The furnace of claim 15, wherein said eutectic or near eutectic metal composition comprises aluminum and between about 21 and about 27 weight percent copper and between about 52 and about 58 weight percent germanium.

21. The furnace of claim 15 wherein said eutectic or near eutectic metal composition comprises aluminum and between about 22.5 and about 25.5 weight percent copper and between about 53.5 and about 56.5 weight percent germanium.

22. The furnace of claim 14, wherein said eutectic or near eutectic metal composition is a binary eutectic or near eutectic of aluminum with copper, germanium, magnesium or silicon.

23. The furnace of claim 14, wherein said eutectic or near eutectic metal composition is a ternary eutectic or near eutectic of (i) aluminum with copper and magnesium or (ii) aluminum with magnesium and silicon.

* * * * *